US005806584A

United States Patent [19]

Thonon et al.

[11] Patent Number: 5,806,584

[45] Date of Patent: Sep. 15, 1998

[54] HEAT EXCHANGER WITH IMPROVED PLATES

[75] Inventors: Bernard Thonon, Le Sappe; Roland Vidil, Grenoble; Claude Roussel, Echirolles; Jean-Michel Grillot, La Tranche, all of France

[73] Assignee: Commissariat a l'Energie Atomique, Paris, France

[21] Appl. No.: 669,291

[22] PCT Filed: Dec. 28, 1994

[86] PCT No.: PCT/FR94/01545

§ 371 Date: Nov. 4, 1996

§ 102(e) Date: Nov. 4, 1996

[87] PCT Pub. No.: WO95/18348

PCT Pub. Date: Jul. 6, 1995

[30] Foreign Application Priority Data

Dec. 29, 1993 [FR] France ..... 93 15816

[51] Int. Cl.[6] ..... F28F 3/08

[52] U.S. Cl. ..... 165/166; 165/167

[58] Field of Search ..... 165/166, 167

[56] References Cited

U.S. PATENT DOCUMENTS

| | | | |
|---|---|---|---|
| 2,550,339 | 4/1951 | Ehrman | 165/167 |
| 3,661,203 | 5/1972 | Mesher | 165/167 |
| 4,014,385 | 3/1977 | Wright | 165/167 |
| 4,563,314 | 1/1986 | Ernst et al. | 165/166 X |
| 4,668,443 | 5/1987 | Rye | 165/166 X |

FOREIGN PATENT DOCUMENTS

| | | | |
|---|---|---|---|
| 57996 | 9/1940 | Denmark | 165/166 |
| 2202271 | 5/1974 | France | 165/167 |
| 1094277 | 12/1960 | Germany | 165/166 |
| 2246114 | 4/1973 | Germany | 165/167 |
| 1173236 | 3/1969 | United Kingdom . | |
| 1162654 | 8/1969 | United Kingdom . | |
| 1183183 | 3/1970 | United Kingdom . | |
| 1486919 | 9/1977 | United Kingdom . | |
| 2340 | 8/1981 | WIPO | 165/166 |

*Primary Examiner*—Leonard R. Leo

*Attorney, Agent, or Firm*—Burns, Doane, Swecker & Mathis, LLP

[57] ABSTRACT

Disclosed is a heat exchanger composed of corrugated plates, the facets (12) of which are provided with bosses (13) and hollows (14) in order to reduce pressure drops.

6 Claims, 3 Drawing Sheets

HEAT EXCHANGER WITH IMPROVED PLATES

DESCRIPTION

This invention relates to a plate-type heat exchanger made up of a stack of corrugated plates delimiting channels of variable section.

Corrugations have the general purpose of disturbing the flow of fluids to increase the heat transfers through the plates, but they have the drawback of making the pressure drops much larger than with flat plates. An earlier French patent (FR-A-2 648 220) described a particular form of corrugated plate which made it possible to reduce the volume of dead or recirculation zones in which the fluid stagnates substantially, which is one of the main causes of losses in heat exchange efficiency and the fouling of plates if the fluid is charged with particles, because they then deposit much more easily. The plates of that earlier invention had facets of two alternately different lengths and were assembled together such that the corrugations of the consecutive plates formed angles of preference of nearly 180° C., i.e. such that, in each channel, the long facets were oriented substantially in the same direction corresponding to the direction of fluid flow in the channel: the short facets thus faced the fluid and, owing to their steeper slope, deviated it strongly towards the long facets of the other plate delimiting the channel. The result was that the fluid stream licked the long facets over a large part of their surface, and the recirculation zones which formed behind the corrugations which restricted the channel, namely in front of the long facets, were reduced as a consequence. One thus obtained better heat exchange performance as well as easier flow.

The objectives assigned to that invention were thus met, but certain drawbacks may be found to such a configuration of plates. First of all, the corrugations composed of a long facet and a short facet have, for the same pitch (the pitch designating the width of the corrugation), a smaller height than the corrugations of a conventional corrugated plate composed of two similar facets. In other words, the channels have a smaller average section. In practice, it is however desirable not to reduce this section, thus requiring the use of plates of similar shape but with larger corrugations having a larger pitch. The lines of corrugations then have a larger spacing and the number of contact points between the plates is smaller, thus reducing the mechanical strength of the stack.

Another drawback stems from the fact that the beneficial effect is obtained only for one direction of fluid flow in each channel, alternating in adjacent channels, thus imposing countercurrent circulation of fluids which is not always desired. Finally, if pressure drops are lower than with conventional corrugated plates, they remain significant.

The present invention may be regarded as an improvement of the earlier invention, because it offers substantially equivalent advantages as concerns the heat exchange performance and the reduced fouling of the walls of the plates, but also substantially smaller pressure drops by the reduction of vortex movements, while still involving the same number of contact points between plates as ordinary corrugated plates. In its best embodiments, the invention also lends itself to similar flows of fluids in both directions, thus allowing the free choice of parallel current flows as well as counterflows.

The invention relates, in its most general form, to a heat exchanger composed of corrugated plates placed side by side to delimit channels, the plates being similar, composed of facets joined by bottom and top lines, with the plates joined to each other at contact points, characterized in that the plates are alternately turned over and joined either through their top lines or through their bottom lines, and in that the facets include bosses near the top lines and hollows near the bottom lines.

This thus provides an arrangement in which the corrugations are flattened and squeeze the section of the channels near the contact points of the corrugations, thanks to this combination of hollows and bosses as described and to the alternate turnover of the plates. The U.S. Pat. No. 4,014,385 describes an arrangement in which the facets include, on the contrary, hollows at the top and bosses at the bottom, so that they are connected to each other to form right angles, which allows the stiffening of the plates but has an effect opposite to that of the invention on the flow of fluid.

It is recommended that hollows and bosses should be discontinuous along the facets, with the bosses located near the contact points, thus enabling them to play the channel volume reduction role only at the locations in which dead or stagnant zones are most likely to form. The bosses are much less useful elsewhere. A simple construction is that in which the facets include hollows and bosses which alternate. Finally, if each contact point is located between two bosses belonging to adjacent facets of the same plate, the reversibility of the flow in the channels is assured.

The invention will now be described in greater detail in conjunction with the following figures appended by way of non-limitative illustration:

Figure 1:
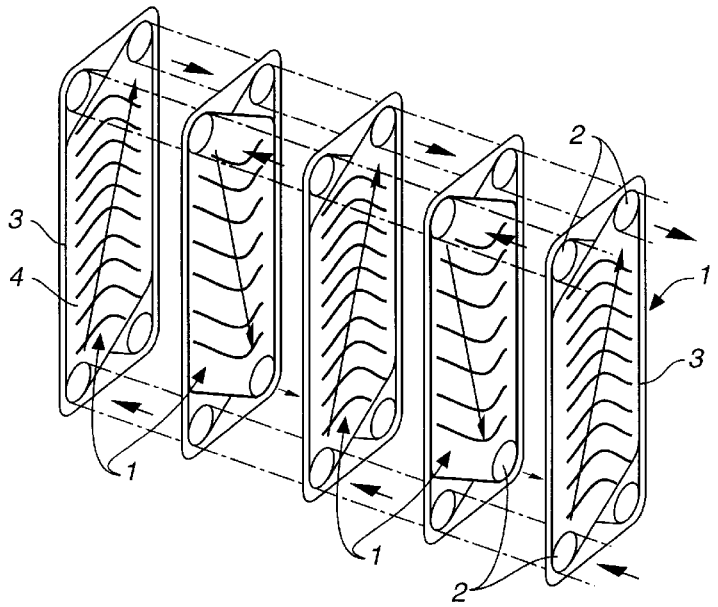
FIG. 1 is a general view of a plate-type heat exchanger in which the plates are represented in an exploded view for clarity.
Figure 2:
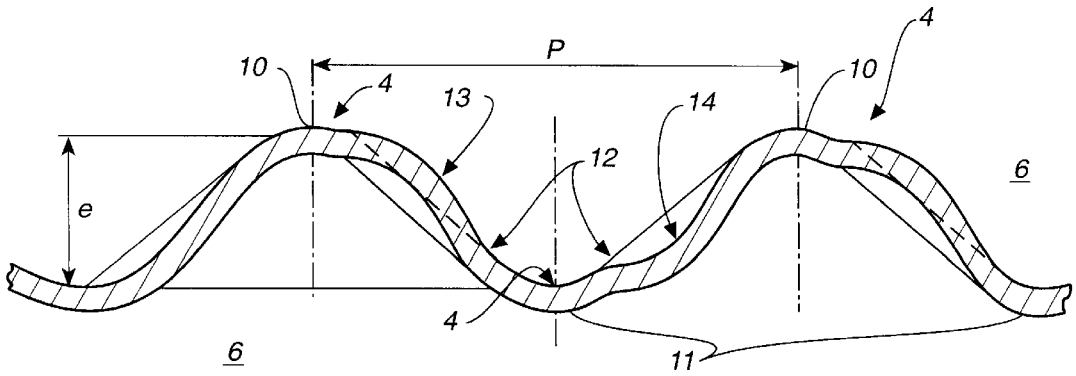
FIG. 2 is a partial sectional view of a plate according to the invention.

A plate-type heat exchanger of a current type is shown in FIG. 1. It is made up of a superposition of rectangular plates 1, having four bores 2 in the corners, a smooth peripheral groove 3 and corrugations 4 on the rest of their surface. The plates may be produced by various means, by stamping, machining or casting, and in the real heat exchanger they bear on each other through their corrugations 4. Gaskets, not represented, are then compressed between the grooves 3 and provide leaktightness. The stack is held by clamping.

In the represented embodiment, there is a countercurrent fluid flow, but it could be otherwise. The corrugations 4 are of herringbone form but could be straight. The fluids are generally liquids in existing embodiments, but this is not obligatory, and there may also be changes of state. The invention is applicable to all these categories of exchangers and even to different kinds of exchangers.

According to the invention (FIGS. 2 to 5), the corrugations 4 of the plates 1 may be broken down into top lines 10 alternating with bottom lines 11, the lines 10 and 11 all being parallel to each other and separating contiguous facets 12. The facets 12 have a rough surface, i.e. they are not straight over the essential part of their length as in conventional corrugated plates, but exhibit bosses 13 and hollows 14. For the requirements of the description, the observation reference is located in the channel 6 over the plate 1, and the top lines 10 are over the bottom lines 11; the bosses 13 are convex reliefs and the hollows 14 are concave reliefs in this channel 6.

Figure 3:
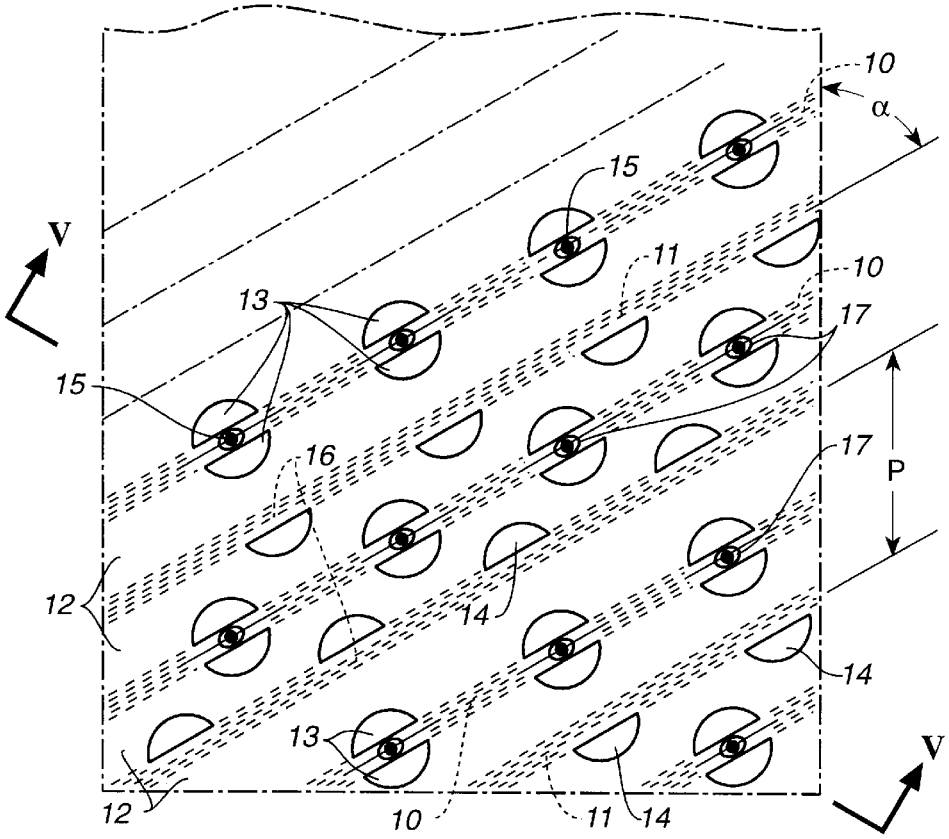
FIG. 3 is a top view of a plate of the invention, showing the distribution of the bosses and hollows.
Figure 4:
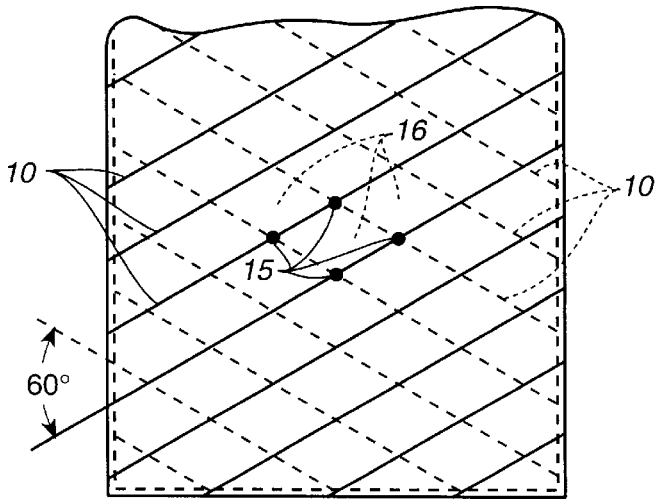
FIG. 4 illustrates how the plates are superposed and in particular the angle of their corrugations.
Figure 5:
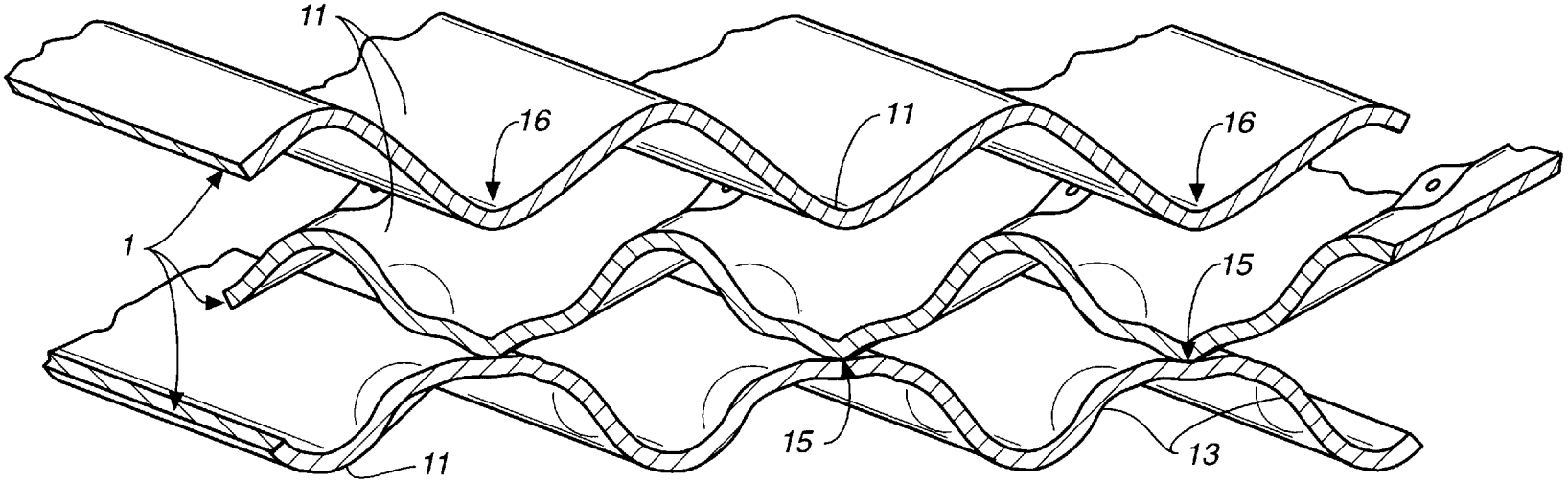
FIG. 5 illustrates the respective positions of the hollows and bosses on the two superposed plates, according to a plane section indicated by the line V—V on a plate in FIG. 3.

Hollows and bosses 14 and 13 are produced without difficulty with the corrugations 4, for example by stamping with special dies, without any special operation. The general representation in FIG. 3 shows that the hollows 14 and the bosses 13 do not extend over the entire length of the corrugations 4 but are, on the contrary, discontinuous and that the bosses 13 extend near the top lines 10, approximately over half of the length of the corrugations 4, and to the locations near the contact points 15 of the adjacent plate 1; more precisely, the bosses 13 of the adjacent facets 12 extend on either side of the middle top line 10 so as to surround in pairs the contact points 15. The hollows 14 are adjacent to the bottom lines 11 and each extends between two consecutive bosses 13 of the facet 12 to which they belong (hollow 14 and bosses 13 thus alternate along each of the facets 12), so that they form a roughly uninterrupted series along each of the bottom lines 11, alternately on the two facets 12 which border it. In this embodiment, the average direction of the flow of fluid in the channel 6 is vertical (according to the representation of this FIG. 3) and the angle $\alpha$ of the corrugations 4 with this direction is 60°. The other plate 1 delimiting the channel 6 will be similar but placed after having been tuned over, so that the plates 1 will join through their top lines 10 (FIGS. 4 and 5), their corrugations 4 being crossed and forming angles of 60°. The same will be true for each couple of plates 1, which will be joined either through their respective top lines 10 or through their bottom lines 11. Whether the direction of flow is ascending or descending, the characteristics of the flow are identical because the form of the channels 6 is symmetrical. It is noted in particular that the bosses 13 form zones in which the section of the channel 6 is very small around the contact points 15, in which the fluid would have a tendency to stagnate, but that the bosses 13 do not contribute to hindering the flow at the other locations of the channels 6.

Similarly, the contact points 16 with the other adjacent plate 1, located at the center of the diamonds formed by four adjacent contact points 15, will be surrounded by two pairs of hollows 14 of the two plates 1 concerned, but which are seen as bosses 13 in the adjacent channel 6 delimited by these two plates 1. It is thus seen that all the channels will have the same form.

The hollows 14 have hardly any influence on the flow in the channels 6.

To allow the proper positioning of the plates in relation to each other, hollows 17 may be provided on the top lines 10 at the contact points 15, between the bosses 13. These hollows make it possible, on the one hand, to position the plates precisely and, on the other, to bettor streamline the flow around the corrugation. These hollows 17 have a depth of about 0. 5 mm (between 0.3 mm and 1 mm) and their form allows engagement of the contact points 15 of the upper plate. They are made in the same way as the rest of the plate, with no additional Cost. The hollows 17 are established on every other plate 1; the top lines 10 of the other plates 1 remain straight.

Bosses could also be provided at the bottom lines 11, at the location of the contact points 16, on certain plates 1 to facilitate also the engagement of the plates 1 by these bottom lines 11.

Other embodiments are possible depending in particular on the angles formed by the corrugations in relation to the average direction of flow.

An embodiment actually tested included plates with corrugations 4 in which the angle $\alpha$ in relation to the flow was equal to 60°, the plates 1 having a pitch p (FIGS. 2 and 3) of 13 mm and a height e (FIG. 2) of 3.9 mm, for maximum heights and depths of 0.8 mm and diameters from 3 to 4 mm for the bosses 13 and the hollows 14. The channels 6 were 0.4 m long and 0.14 m wide. The flow rate was 6 to 40 $m^3$ per hour in each channel 6. The plates 1 in accordance with the invention produced a head lose (or pressure drop) from 30 to 50% smaller than a conventional corrugated plate, i.e. without bosses 13 and hollows 14. The heat exchange coefficients were similar, with differences of less than 5%. The plates consisted or stainless-steel stampings 0.6 mm thick.

The invention can be applied to all fields of activity in which exchangers of this type are used, and in particular the chemical, para-chemical, petroleum, climatic, agro-food, energy production and metallurgical industries.

We claim:

1. A heat exchanger comprising stacked corrugated plates, the plates defining fluid channels therebetween, the plates being composed of facets joined at bottom lines and top lines, wherein the plates are similar in shape and alternatively turned over, the top lines of a first of the plates being joined to the top lines of another of the plates and the bottom lines of the first plate being joined to the bottom lines of still another one of the plates at contact points, the facets including bosses near the top lines and hollows near the bottom lines.

2. The heat exchanger of claim 1, wherein the hollows and the bosses are discontinuous along the facets and the bosses are located near the contact points.

3. The heat exchanger of claim 2, wherein the hollows and the bosses alternate along the facets.

4. The heat exchanger of claim 2, wherein each of the contact points is located between a pair of the bosses.

5. The heat exchanger of claim 4, wherein one boss of the pair of bosses is located on one of the facets and a second boss of the pair of bosses is located on a second adjacent one of the facets.

6. The heat exchanger of claim 1, wherein special hollows are located at the contact points to provide a fitting adjustment of the plates.

* * * * *